US006794966B2

(12) United States Patent
Thrush et al.

(10) Patent No.: US 6,794,966 B2
(45) Date of Patent: Sep. 21, 2004

(54) LOW NOISE RELAY

(75) Inventors: Roger L. Thrush, Clemmons, NC (US); Robert D. Irlbeck, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/434,832

(22) Filed: May 9, 2003

(65) Prior Publication Data

US 2004/0000981 A1 Jan. 1, 2004

Related U.S. Application Data

(60) Provisional application No. 60/393,213, filed on Jul. 1, 2002.

(51) Int. Cl.[7] ..... H01H 51/22
(52) U.S. Cl. ..... 335/80; 335/128
(58) Field of Search ..... 335/78, 80, 86, 335/128

(56) References Cited

U.S. PATENT DOCUMENTS 4,228,412 A * 10/1980 Dalley et al. ..... 335/152
4,460,881 A * 7/1984 Meister et al. ..... 335/128
5,321,377 A * 6/1994 Aharonian ..... 335/78
5,389,905 A * 2/1995 Shibata et al. ..... 335/78
6,590,480 B2 * 7/2003 Matsuda ..... 335/78

FOREIGN PATENT DOCUMENTS

JP 62-223931 10/1987 ..... H01H/51/06
JP 05120971 A * 5/1993 ..... H01H/50/30
JP 06052774 A * 2/1994 ..... H01H/50/30
JP 2002-184290 6/2002 ..... H01H/50/30

OTHER PUBLICATIONS

Patent Abstracts of Japan, Publication No. 05174684, Publication Date, Jul. 13, 1993, Application Date, Dec. 19, 1991, Application No. 03335390.

* cited by examiner

*Primary Examiner*—Lincoln Donovan
*Assistant Examiner*—Bernard Rojas

(57) ABSTRACT

An electromagnetic relay (2) includes noise dampening means (20/32/34), such as an elastomeric insert, a noise dampening composition or mataerial, or a resin located at the juncture between the relay armature (4) and the spring (6), which noise dampening means (20/32/34) reduces noise generated by contact between the armature (4) and the spring (6) as the relay (2) is energized and the armature (4) is pulled into the core (8) and when the relay (2) is de-energized and the spring (6) biases the armature (4) away from the core (8).

16 Claims, 6 Drawing Sheets

LOW NOISE RELAY

CROSS REFERENCE TO RELATED APPLICATIONS

This application claims the benefit of co-pending Provisional Patent Application No. 60/393,213, filed on Jul. 1, 2002.

BACKGROUND OF THE INVENTION

1. Field of the Invention

The invention relates to electromagnetic relays in general and, in particular, to relays having reduced acoustic noise during pull-in and drop-out. More particularly, the invention relates to an electromagnetic relay having noise dampening means, such as an elastomeric composition, a curable resin or other mechanical dampening composition or material disposed at a juncture between the relay armature and the movable spring in the relay to dampen acoustic noise.

2. Description of the Prior Art

Although reliable and effective from an electrical and mechanical perspective, the noise emitted by a prior art relay, such as that shown in FIGS. 1–3, during mating and unmating can be objectionable when used in certain applications. For example, a relay of this type, as well as comparable relays used for similar applications, can generate an audible noise, when used in proximity to a passenger compartment of an automobile. Extensive steps have been taken to reduce the noise in the passenger compartment, especially in luxury automobiles, and conventional relays used in this environment are considered to be a significant source of unwanted noise.

Relays include a movable contact mounted on a movable spring. The spring holds the movable contact in engagement with a normally closed contact until an increase in coil current generates a magnetic force above a pull-in threshold. An armature, attached to the spring, is attracted to the coil core by the magnetic force. The collision between the armature and the coil core results in an audible sound, which can be magnified due to resonance caused by the cover or other parts of the relay housing. Noise during drop-out occurs when the magnetic force is reduced so that the spring urges the movable contact into engagement again with the normally closed contact. This collision with the normally closed contact can also result in an objectionable noise, even thought the relay has properly performed its switching function.

FIG. 4 is a partial subassembly including an armature 40 and a spring 42 that is used in another prior art relay manufactured and sold by Denso (Malaysia) Sdn Bhd. The part number for this relay is not known. The relay has a die cut plastic or rubber pad 44 positioned between the armature 40 and the spring 42. The specific purpose of this pad 44 is not known. However, manufacture of this relay would appear to be complicated and expensive, requiring a specifically designed armature, and the precise placement of the pad 44 prior to attachment of the armature 40 to the spring 42.

SUMMARY OF THE INVENTION

An electromagnetic relay according to this invention includes a magnetic subassembly including a coil surrounding a core. The relay also includes an armature with a contact. When an electric current is applied to the coil, a magnetic force is generated which attracts the armature to the core. A spring biases the armature away from the core so that, when the electric current and magnetic field dissipate, the armature and contact are returned to their original position. Noise dampening means, such as an elastomeric composition or a cured resin composition, for example, is disposed at a juncture between the between the armature and the spring. In one embodiment, the noise dampening means is disposed between the armature and the spring. In another embodiment, the noise dampening means is located at an edge of the armature where it meets the spring. An electromagnetic relay in accordance with this invention exhibits low acoustic noise characteristics upon during pull-in and drop-out.

A resin exhibiting mechanical damping adhering to the spring and to the armature can reduce acoustic noise upon actuation of the relay. A resin or other compositions exhibiting mechanical damping can be deposited on a surface of the relay spring adjacent to an edge of the armature. Deposition of the resin after the armature has been mechanically attached to the spring can simplify manufacture of this low noise relay.

DETAILED DESCRIPTION OF THE PREFERRED EMBODIMENTS

Figure 5:
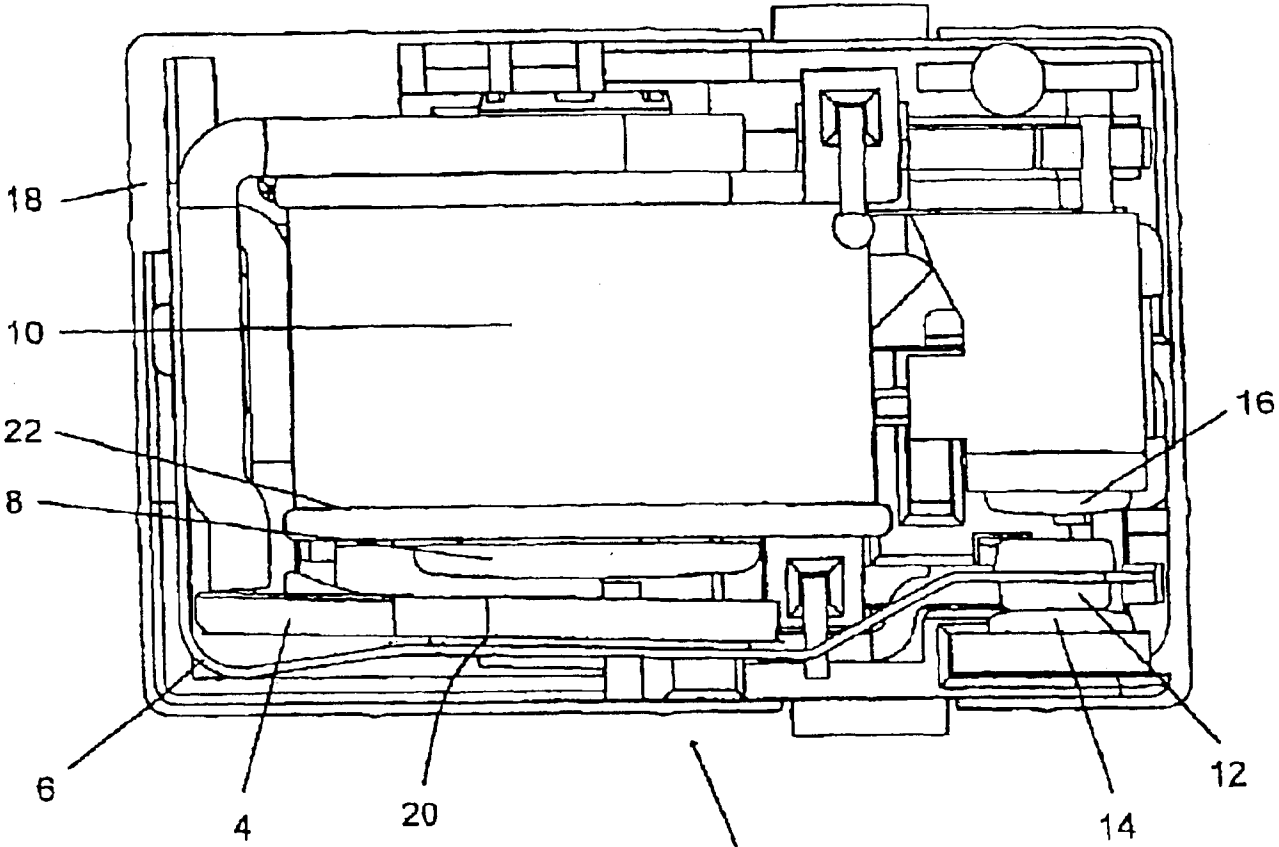
FIG. 5 is a top view of the low noise relay assembly of this invention showing the armature and relay contacts in the normally closed position.
Figure 6:
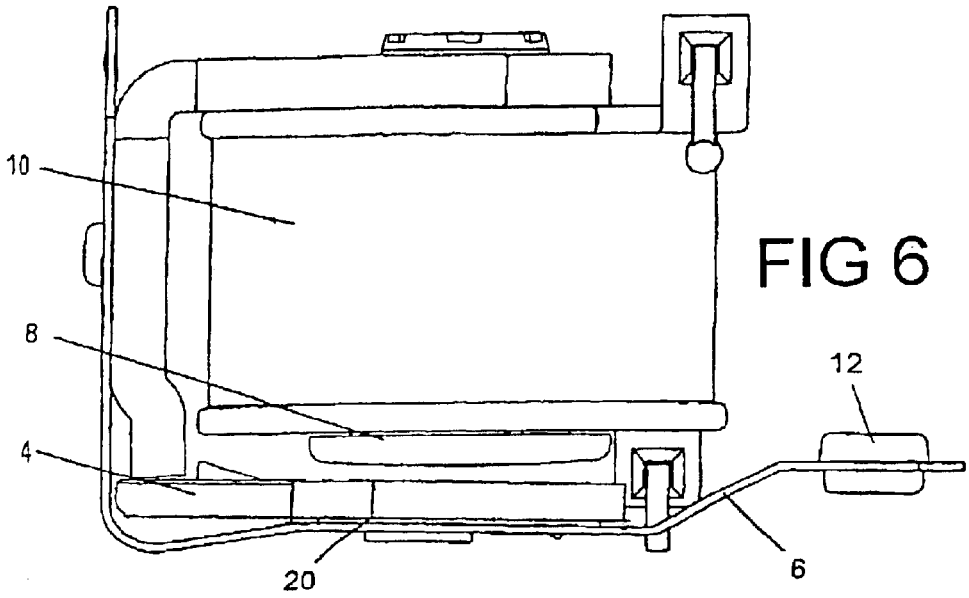
FIG. 6 is a top view similar to FIG. 5, but showing only a partial assembly including the frame, coil assembly, the armature and spring and the movable contact.
Figure 7:
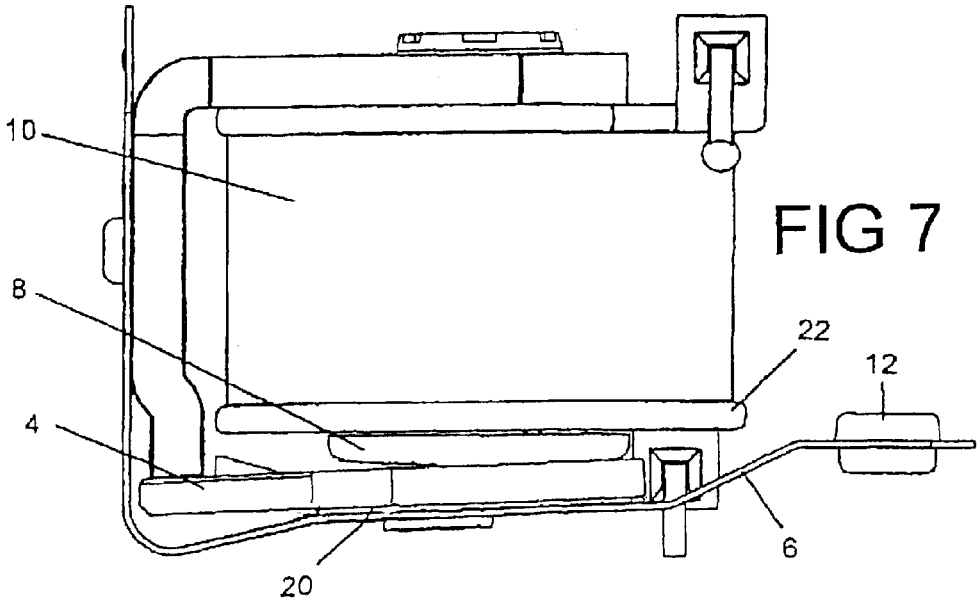
FIG. 7 is a top view similar to that of FIG. 6, with the armature engaged with the core in the normally open position.

With reference to FIGS. 5–7, an electromagnetic relay 2 in accordance with a first embodiment of this invention includes noise dampening means 20 positioned between the relay armature 4 and the movable spring 6. In operation, the armature 4 is pulled toward the relay magnetic subassembly (which can include the relay coil or winding 10, the relay core 8 and the relay bobbin 22) when the relay is energized. When the relay is de-energized, the spring 6 returns the armature 4 to its normally position shown in FIGS. 5 and 6. The noise dampening means 20 reduces the acoustic noise generated by the relay during both the energizing (i.e., "pull-in") and de-energizing (i.e., "drop-out") cycles. Since acoustic noise can be magnified by resonance due to the relay structure, including the base, spring, cover and frame, a reduction in the noise due to impact will be cumulative.

Reduction in acoustic noise can be achieved by using this invention on a variety of relays without significantly increasing the cost or complexity of the relay. Noise dampening means 20 can be added to many types of electromagnetic relays without adversely affecting the operation of the relay. In order to demonstrate the use of the noise dampening means in accordance with the first embodiment of this invention, its addition to the prior art relay shown in FIGS. 1–3 will be described, after first discussing the structure and function of this prior art relay.

Figure 1:
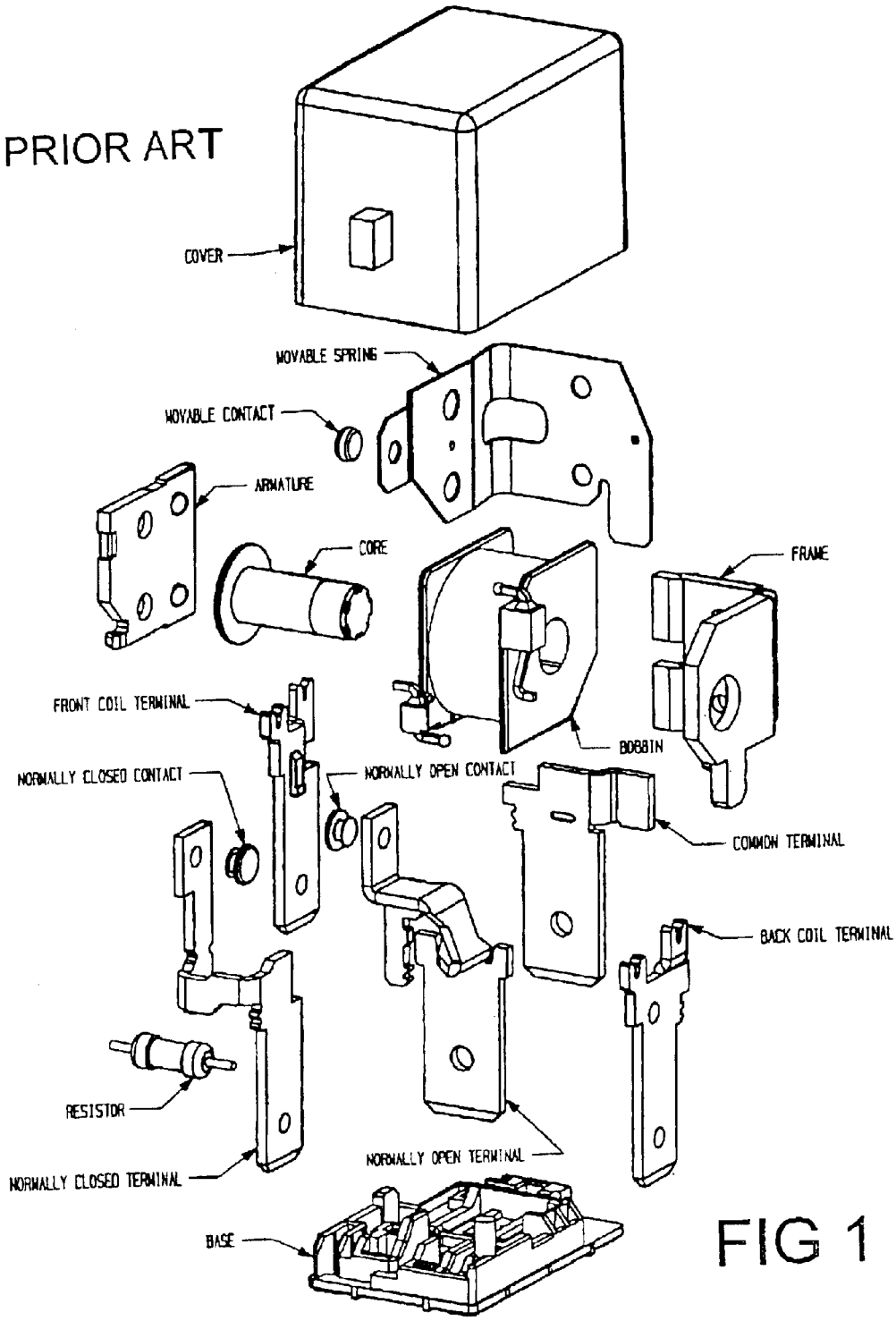
FIG. 1 is an exploded perspective view of a prior art electromagnetic relay, which does not employ the low noise features of the instant invention.
Figure 2:
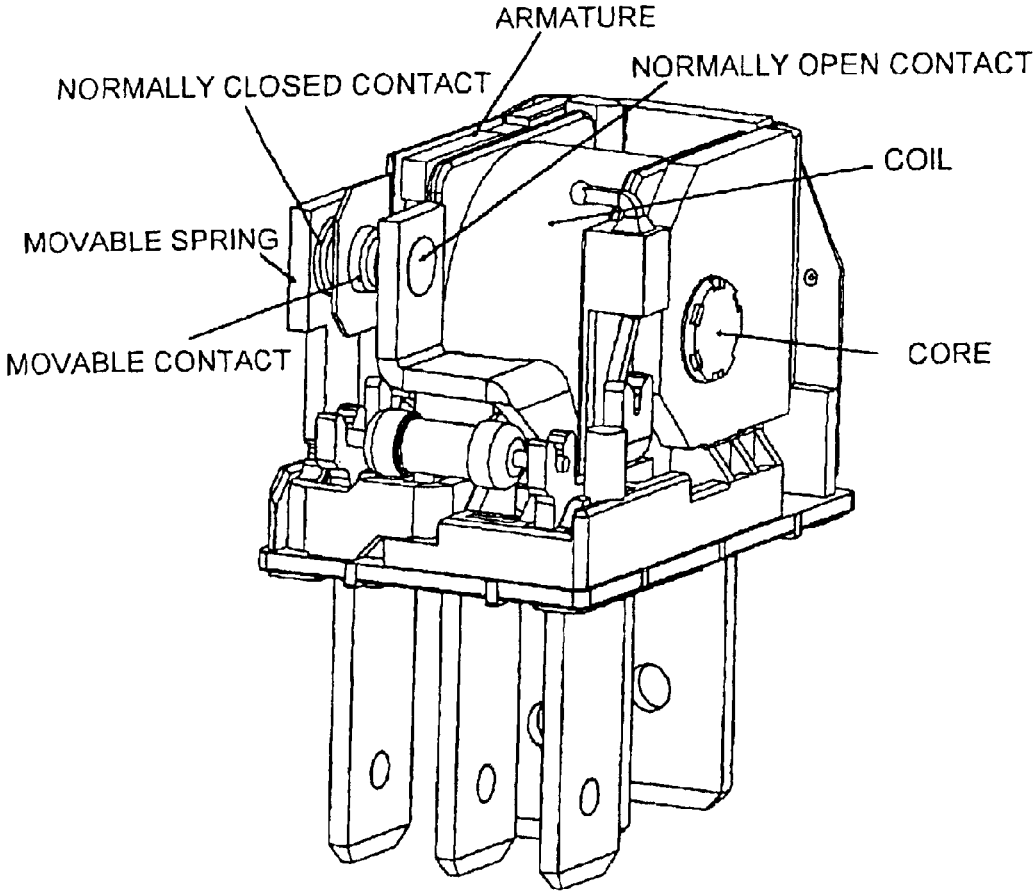
PRIOR ART FIG 2
FIG. 2 is a perspective view showing the assembled components of a prior art relay shown with the relay cover removed.
Figure 3:
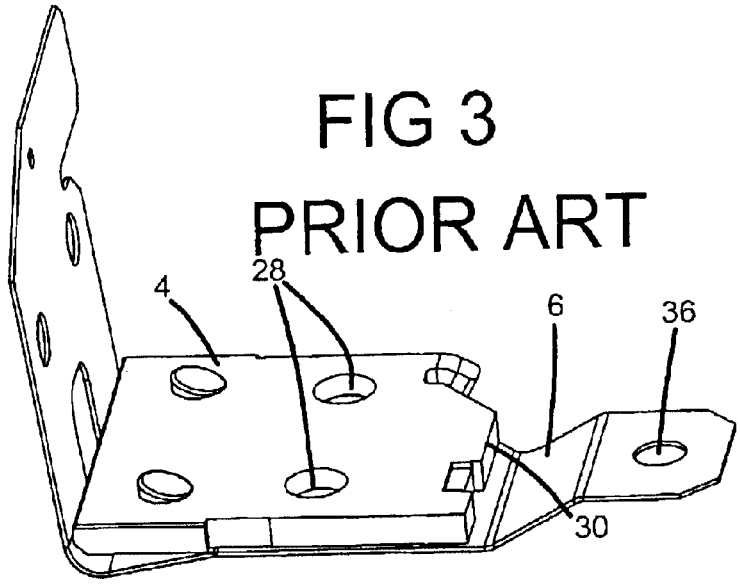
FIG 3 PRIOR ART
FIG. 3 is a perspective view of the spring and armature subassembly used in the prior art relay shown in FIG. 2.
Figure 4:
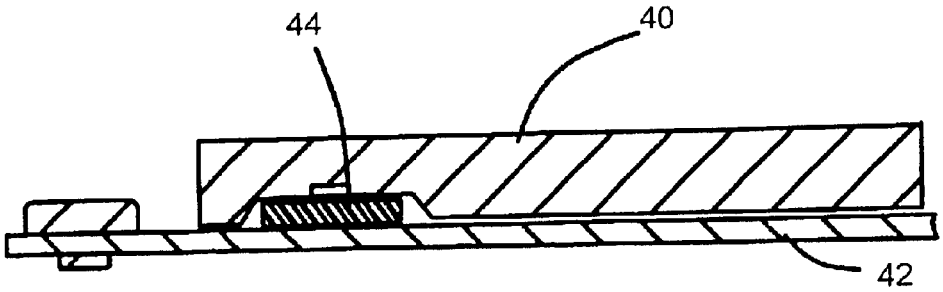
FIG 4 PRIOR ART
FIG. 4 is a partial view of a spring and armature subassembly of another prior art relay.

The prior art electromagnetic relay shown in FIGS. 1–3 is a conventional relay including both normally open and normally closed stationary contacts. A movable contact is shifted between the two stationary contacts by the presence or absence of a magnetic force generated by a current flowing through a coil or winding. An armature is moved into engagement with a core, extending through the coil or winding, when a current is applied to the coil to generate a pull in force. The armature is attached to a movable spring, and the electromagnetic force generated by the field established by current flowing through the coil must be sufficient to overcome a restoring force generated by the movable spring.

In the particular relay shown in FIGS. 1–3, the movable contact is mounted on the end of the movable spring. The portion of the movable spring on which the movable contact is mounted extends beyond the armature, which comprises a relatively rigid ferromagnetic member. The opposite end of the L-shaped movable spring is fixed to the frame, which also comprises a relatively rigid member. In this electromagnetic relay, a rear edge of the armature abuts an adjacent edge of the frame, and the movable spring extends around these abutting edges at least through a right angle so that the spring will generate a restoring force that will tend to move the armature away from the coil. In other words, when the movable spring is in a position in which there will be relatively less stress on the spring, the armature will be spaced from the core.

In the relay depicted in the Figures, the armature is positioned so that when the armature engages the core, the armature will be tilted relative to the core. In other words, the abutting edge of the frame is laterally spaced beyond the exterior face of the core. This tilt or inclination is best seen in FIG. 7, which shows the armature 4 including the noise dampening means 20. However, in the prior art relay, the armature is also inclined when in engagement with the core. This inclination or tilt insures that the armature and the core will engage at prescribed points to insure reliable operation within appropriate dimensional manufacturing tolerances. It should be understood however, that a noise dampening means in accordance with this invention could be employed on relays in which the precise orientation of the armature and the coil may differ from that depicted herein. For example, a noise dampening means can be used on a relay in which the armature and the coil engage each other on flat, substantially parallel surfaces.

Direct contact or near direct contact between the armature and the core at the end of the pull-in switching operation is important to relay performance. Direct contact, so that only very small gaps exist between the armature and the core, provides a very large magnetic force, which essentially locks the two components together. High resistance to vibration and shock are primary benefits as is a low drop-out voltage, making the relay less sensitive to voltage variations after it has closed.

When a current flows through the relay coil or winding, the armature is magnetically attracted to the core. A sufficient force exerted by the electromagnetic field will overcome the force of the spring tending to keep the movable contact in engagement with the normally closed contact. As the armature moves into engagement with the core, the movable contact will first come into engagement with the normally open contact and current will flow between the movable contact and the normally open contact. Current will flow between the common terminal, attached to the movable spring, and the normally open terminal. Overtravel of the spring is also desirable in order to maintain a continuous contact with sufficient normal force acting between the movable contact and the normally open contact. This overtravel is achieved in the prior art relay because all of the attractive force is generated by the action of the electromagnetic field on the armature, which is the largest movable mass. The overtravel is achieved by having the movable contact engage the normally open contact prior to engagement of the armature with the core.

The further motion of the armature to reach its seated position on the core flexes the portion of the spring between the armature and the movable contact and generates a resilient force between the contacts. This will provide force on the contacts even if the contacts wear down or the terminals move away due to thermal expansion or for some other reason. As the armature is drawn closer to the core by this electromagnetic force, the spring is flexed to transfer greater normal force to the mating contacts. Of course the greater the force acting on the armature, the greater will be the impact of the armature on the core and the impact of the movable contact on the normally open contact. The force generated by overtravel actually is directed against the seating motion of the armature to the core. As such, it actually helps reduce the velocity of the armature prior to its impact with the core. However, the force from overtravel directly contributes to drop-out noise, as although the force from the spring at the hinge point is acting to separate the contact in the absence of a magnetic field, the overtravel spring easily doubles the separation force during the short time when the contacts are still engaged.

The magnetic force on the armature increases almost exponentially as the gap between the core and the armature is reduced. Typically the magnetic force over much of the range of motion of the armature grows at a similar rate to the increase in the resisting spring force. However, during the second half of overtravel, the magnetic force dramatically increases relative to the spring force. A strong impact between the armature and the core will generate more acoustic noise, but a larger attractive force will also generate greater mating velocity, which will reduce the possibility of undesirable arcing during mating. A high mating velocity and a rapid build up of force ensures that the contacts have sufficient contact area during inrush current inherent to lamp loads to prevent contact overheating, melting and welding. Therefore, a large attractive force is desirable, even though it will result in more acoustic noise.

The improved acoustic performance of electromagnetic relays incorporating the embodiments is premised upon the realization that a significant and noticeable contribution to acoustic noise is due to the noise generated by the armature in a relay of relatively standard design. The impact of the armature against the coil core causes an impulse that excites the relay structure during pull-in. During drop-out, the armature will impact against the spring arm in some designs. In other designs, the contact impacts will be the source of noise during drop-out. The possible impact with the spring is a result of pre-bias and is not related to stopping the opening motion of the armature. In all designs the armature must be stopped by some means. The embodiments reduce acoustic noise generated by the armature by absorbing impact between the armature and the spring and damping spring vibrations as the armature reaches its fully open or fully closed positions.

FIGS. 5–7 show noise dampening means 20 sandwiched between the armature 4 and the spring 6 in an otherwise conventional electromagnetic relay 2. The resilient spring 6 is attached to frame 16. The armature 4, noise dampening means 20 and spring 6 form a subassembly that extends along two sides of a magnetic subassembly comprising a coil or winding 10, a bobbin 22, a core 8 and the frame 18. The movable contact 12 is mounted on the movable flexible spring 6 between a normally closed contact 14 and a normally open contact 16. FIG. 5 shows the assembly in an open or drop-out position in which the movable contact 12 is engaged with the normally closed contact 14 and the armature 4 is spaced from the core 8. In this position, insufficient electromagnetic force exists to pull the armature 4 toward the core 8.

FIG. 6 is a partial assembly of components in the same position as shown in FIG. 5. The relay base, the contacts 14 and 16 are not shown so that the position of the noise dampening means 20 in relation to the armature 4 and the core 8 is more readily seen.

FIG. 7 shows the position of the armature 4 relative to the core 8 in the full pull-in position. In this embodiment, the core 8 has a circular cross sectional shape and the point of primary contact between the armature 4 and the core 8 is along the periphery of the core 8 in the area furthest from the frame 18. The tilted or inclined position of the armature 4, relative to the core 8, is clearly shown. In the preferred embodiment the tilted orientation of the armature 4, which locally extends at an acute angle relative to the core 8, is not appreciably different from the orientation for a standard relay.

A number of materials may be used to advantage as the noise dampening means 20. Urethanes are rated to 155° C., which may seem sufficient for a relay having a maximum relay ambient temperature of 125° C. However, in some applications internal temperatures within the relay can be as high as 180° C. during worst-case conditions. Degradation of the urethane over time may result from these conditions. Initial experiments show that degradation does not impact relay performance, but the sound reduction capabilities are adversely affected. Urethane becomes substantially harder at operating temperature of −30° C., which might have deleterious effects on the performance of the relay. However, despite these drawbacks, urethane would appear to be a suitable material for noise reduction in some circumstances.

Silicone exhibits almost ideal hardness and temperature range characteristics for use in forming the dampening layer 20. However, most silicones can out-gas volatile, uncured material. The out-gassed material can deposit on nearby surfaces, including the contacts in the relay. When exposed to heat from the arcing that can occur within the relay, there deposits can form an electrically insulating glass coating on the contacts, rendering the relay inoperative. However, specially formulated silicone compositions are commercially available which have low out-gassing characteristics. Many of these formulations were designed for space-related applications under extreme conditions of high temperature and vacuum which tend to dramatically accelerate out-gassing. These and other low volatility silicones could be acceptable for use inside a relay, especially in the very small amounts needed to practice this invention.

The noise dampening means need not be a continuous sheet form. Indeed, from a manufacturing standpoint, the noise dampening means may be formed by use of a semi-liquid material, such as a caulk. It has been found that 2 drops of a low out-gassing silicone caulk positioned between the armature and the spring is sufficient to obtain significant noise reduction (i.e., the sound pressure level (or SPL) RMS fast response at 100 mm from a microphone will be below 60 dBa).

A cold cast multiple component resin may also be used to form the noise dampening means 20. A multi-component resin can be deposited between the armature and the spring and subsequently cured. One suitable hydrocarbon based resin that is isocyanate-free and silicone-free is Guronic® D0FR0, which is commercially available from Paul Jordan Elektrotechnische Fabrik GmbH & Co. KG, Berlin, Germany. This standard composition can also be modified to adjust both pot life times and cure times for more efficient fabrication of the spring-armature subassembly.

In the embodiments just described, the noise dampening means is positioned between the armature and the spring. While these embodiments result in appreciable noise reduction in the relay, they can complicate the manufacturing process because the noise dampening means must be applied before the armature and spring are attached together, such as, for example, by a pair of spin rivets 28. To address this potential disadvantage, the alternate embodiment of FIGS. 8–9 simplifies manufacture of the armature-spring subassembly by permitting deposition of the noise dampening means after the armature has been mechanically attached to the spring.

Figure 8:
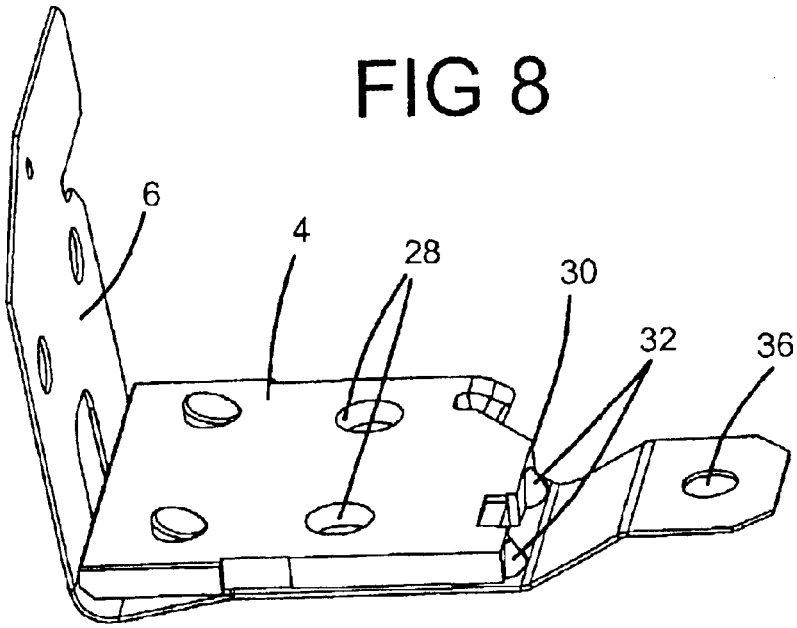
FIG. 8 shows the deposition of a resin prior to curing on the relay spring in accordance with a second embodiment of this invention.
Figure 9:
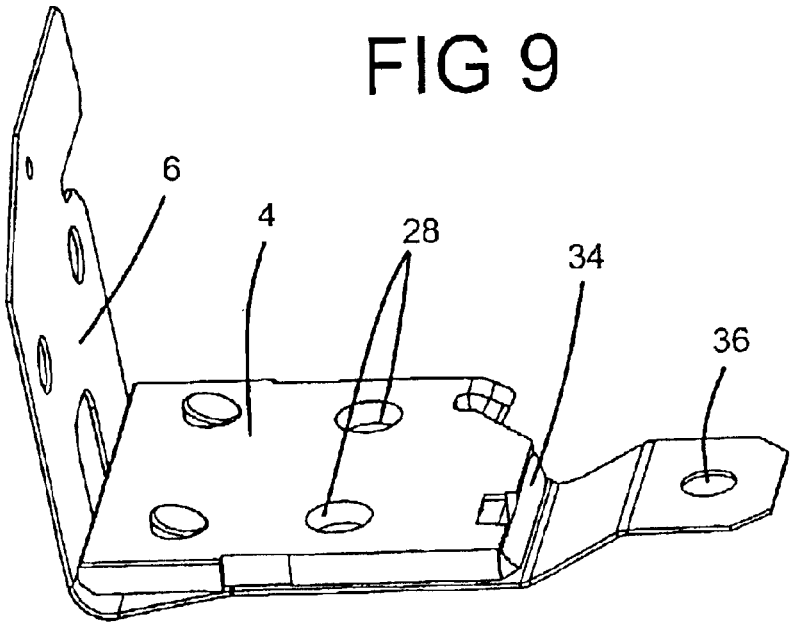
FIG. 9 shows the resin deposited in FIG. 8 after settling or flowing out and being cured, adhering to both the relay armature and to the spring that can be deposited after the armature is mechanically attached to the spring and which will provide mechanical damping for audible noise reduction.

In this alternative embodiment depicted by FIGS. 8 and 9, the noise dampening means is deposited on the surface of the spring 6 adjacent an edge 30 of the armature 4 as shown in FIG. 8. Edge 30 extends transversely relative to the inner spring surface on which the noise dampening means is deposited. Edge 30 is the edge of the armature that faces the movable contact 12 attached to the end of the spring 6. Particularly preferred noise dampening means for these embodiments include resins that will adhere to both the edge 30 of the armature 4 and to the spring 6.

One method of depositing a suitable material is shown in FIG. 8, where two drops 32 of a resin material are deposited on the spring 6 adjacent to edge 30 of the armature 4. The material flows laterally until the drops 32 coalesce to form a bead 34 covering the juncture between the spring 6 and the edge 30 of armature 4. The resin material is then cured in the normal manner.

Although it is possible that some material will also wick between the armature 4 and the spring 6, due to capillary action, most of the resin will remain in contact with the edge 30 of the armature 4 and the spring 6. Care must be taken to prevent any cured resin from being located on the exposed surface of the armature 4 where it might otherwise come into contact with the relay core 8. The resin forming the bead 34 will adhere to both the armature edge 30 and to spring 6 and will restrict movement, flexure and vibrations of the spring 6 relative to the armature 4, thus reducing acoustic noise associated with such vibrations.

The resin bead 34 is located between the armature 4 and the movable relay contact 12, which will be mounted in hole 36 on the end of the spring 6 as shown in FIGS. 8 and 9. It also follows that the resin bead 34 is located between the mechanical snap rivets 28, forming the main mechanical attachment of the armature to the spring, and the movable contacts 12. That portion of the spring 6 extending between the armature 4 and the movable contact 12 will remain free to flex when the movable contact 12 engages one of the stationary contacts 14, 16.

A suitable resin for use in the embodiment of FIGS. 8 and 9 is Guronic® D0FR0 casting resin, a two-component hydrocarbon based, isocyanate-free and silicone-free curable resin that is commercially available from Paul Jordan Elektrotechnische Fabrik GmbH & Co. KG, Berlin Germany. This resin, when cured, remains relatively soft and has a Shore A hardness of approximately 30. It is non-toxic, environmentally safe, requires no special safety precautions, has excellent adhesion, good temperature resistance, high mechanical attenuation, and exhibits very little shrinkage during cure. This relatively viscous material deposited in this manner described above has been found to exhibit mechanical damping sufficient to reduce the noise generated by the relay during pull-in and drop-out. For example, the noise generated by a relay using the invention described with reference to FIGS. 8 and 9 has been found to reduce the noise by at least approximately the same amount as for the first embodiments. The operation or performance of the relay is not affected in any negative way.

This noise dampening means in these embodiments is not limited to the use of the specific resin that is discussed with reference to the embodiment of FIGS. 8 and 9. Other material may also be used. The disadvantages of polyurethanes and silicone resins have been previously discussed, but in some applications these alternative materials may be acceptable. Other resinous or non-resinous compositions may also result in reduction of the audible acoustic relay noise, and might be substituted for the specific material preferred for use with this second embodiment of the invention.

Inasmuch as the embodiments depicted herein has been specifically referred to as a representative embodiments, and because this invention is equally applicable to numerous standard relay configurations, and since a number of modifications have been discussed, it should be apparent that the invention is defined in terms of the following claims and is not limited to specific embodiments shown or discussed herein.

We claim:

1. An electromagnetic relay comprising:

a) a magnetic subassembly including a coil surrounding a core;

b) an armature movable between a first position in contact with the core and a second position spaced from the core, said armature being movable in response to generation of a magnetic field in the core;

c) a spring biasing the armature into the second position; and d) noise dampening means located at the juncture between the armature and the spring and cured on at least one of the armature and the spring.

2. The electromagnetic relay of claim 1, wherein the armature is inclined relative to the core when in engagement with the core.

3. The electromagnetic relay of claim 1, wherein a movable contact is mounted on the spring and makes electrical connection with a normally open contact when the armature is in the first position and a normally closed contact when the armature is in the second position.

4. The electromagnetic relay of claim 1, wherein the relay generates sound levels of less than 60 dBa.

5. The electromagnetic relay of claim 1, wherein the noise dampening means comprises a layer of noise dampening material disposed between the spring and the armature.

6. The electromagnetic relay of claim 5, wherein the noise dampening means comprises a layer of semi-liquid material.

7. The relay of claim 1, wherein the noise dampening means is disposed along an edge of the armature extending transverse to the spring adjacent the juncture of the spring and the armature.

8. The electromagnetic relay of claim 7, wherein the noise dampening means comprises a resin.

9. The electromagnetic relay of claim 8, wherein the resin comprises a two-component cured resin composition.

10. The electromagnetic relay of claim 8, wherein the armature is mechanically attached to the spring.

11. The electromagnetic relay of claim 10, wherein the resin is positioned at a location along the spring spaced from the mechanical attachment of the armature to the spring.

12. The electromagnetic relay of claim 11, wherein the resin is positioned at a location along the spring between the mechanical attachment of the armature to the spring and a movable contact attached to the spring.

13. The electromagnetic relay of claim 8, wherein the resin is positioned along the spring between a point at which the armature contacts the core and a movable contact mounted on the spring.

14. The electromagnetic relay of claim 8, wherein the resin restricts flexure of the spring relative to the armature.

15. The electromagnetic relay of claim 8, wherein the resin comprises an isocyanate-free and silicone-free two-component cold casting hydrocarbon based composition.

16. The electromagnetic relay of claim 8, wherein resin is present only on surfaces on the armature that do not engage the core.

* * * * *